US008004546B2

(12) United States Patent
Miyadera

(10) Patent No.: US 8,004,546 B2
(45) Date of Patent: Aug. 23, 2011

(54) DEVIATION AMOUNT DETECTING DEVICE, DEVIATION AMOUNT DETECTING METHOD, AND COMPUTER-READABLE RECORDING MEDIUM

(75) Inventor: Tatsuya Miyadera, Osaka (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 12/359,372

(22) Filed: Jan. 26, 2009

(65) Prior Publication Data

US 2009/0190940 A1 Jul. 30, 2009

(30) Foreign Application Priority Data

Jan. 28, 2008 (JP) ..... 2008-016581
Jan. 22, 2009 (JP) ..... 2009-011933

(51) Int. Cl.
*B41J 2/385* (2006.01)
*G03G 15/01* (2006.01)

(52) U.S. Cl. ..... 347/116; 399/301

(58) Field of Classification Search ..... 347/116, 347/229, 234, 248, 249, 231, 243, 244, 258–260; 399/301

See application file for complete search history.

(56) References Cited

U.S. PATENT DOCUMENTS

| | | | | |
|---|---|---|---|---|
| 5,963,355 | A * | 10/1999 | Iizuka | 359/205.1 |
| 6,282,396 | B1 * | 8/2001 | Iwata et al. | 399/301 |
| 7,239,833 | B2 * | 7/2007 | Tomita et al. | 399/299 |
| 7,306,313 | B2 * | 12/2007 | Kamimura et al. | 347/19 |
| 7,623,143 | B2 * | 11/2009 | Kitao | 347/116 |
| 2008/0038024 | A1 | 2/2008 | Miyadera | |
| 2008/0069602 | A1 | 3/2008 | Miyadera | |
| 2008/0170868 | A1 | 7/2008 | Miyadera | |
| 2008/0212986 | A1 | 9/2008 | Miyadera | |

FOREIGN PATENT DOCUMENTS

| | | | |
|---|---|---|---|
| JP | 2000075593 | A * | 3/2000 |
| JP | 2005-103927 | | 4/2005 |
| JP | 2006-259444 | | 9/2006 |
| JP | 2006313251 | A * | 11/2006 |

* cited by examiner

*Primary Examiner* — Hai C Pham
(74) *Attorney, Agent, or Firm* — IPUSA, PLLC

(57) ABSTRACT

A deviation amount detecting device for use in an electrophotographic color image forming device is configured to detect whether a deviation for each of toner images of different colors on a transporting member takes place, based on position information which is stored as a result of reading of a first set of deviation detecting patterns by a pattern reading unit.

4 Claims, 13 Drawing Sheets

DEVIATION AMOUNT DETECTING DEVICE, DEVIATION AMOUNT DETECTING METHOD, AND COMPUTER-READABLE RECORDING MEDIUM

BACKGROUND OF THE INVENTION

1. Field of the Invention

This invention relates to a deviation amount detecting device which computes an amount of deviation for each of multiple toner images of different colors in a color image forming device wherein a color image is formed by superimposing the toner images of different colors.

2. Description of the Related Art

In a tandem type color image forming device, a color image is formed on a recording sheet or an intermediate transfer belt by using four image formation units of different colors which are arranged to superimpose the toner images on one another on the recording sheet or the intermediate transfer belt.

In the image forming device of this type, if the position where the toner images of the respective colors are superimposed slightly deviates from a desired position, it is difficult to stably obtain a color image with good quality. To avoid this problem, deviation compensation patterns of the respective colors formed on a transporting member are detected, and the deviation compensation is performed so that the toner images of the respective colors are superimposed at the same position. Specifically, by this deviation compensation, each of the detection results of color patterns (cyan, magenta and yellow) is compared with the detection result of a reference color pattern (black), and an amount of deviation of each color pattern to the reference color pattern is computed.

However, even if the computation of the amount of deviation and the deviation compensation are performed, a deviation will take place again according to various factors with the passage of time. Especially, if the reflection characteristics of the reflection mirror of the image forming device change due to a temperature rise of the exposure unit of the image forming device, a deviation may easily take place.

Conventionally, in order to correct the deviation which takes place due to the temperature rise of the exposure unit, it is necessary to frequently perform a deviation compensation process using the deviation compensation patterns. Refer to Japanese Laid-Open Patent Application No. 2005-103927 and Japanese Laid-Open Patent Application No. 2006-259444.

However, the deviation compensation process using the conventional deviation compensation patterns needs to form many color patterns on a transporting belt, needs to read these color patterns by the sensors, and needs to perform the computation to compute the amounts of deviation based on the results of reading of the color patterns. Thus, the deviation compensation process using the conventional deviation compensation patterns requires a series of several tasks, including the formation of color patterns on the transporting belt, the reading of the color patterns by the sensors and the computation based on the pattern reading results, and much time is needed to complete the deviation compensation process.

The amount of deviation for one of the different colors produced due to a temperature rise in the exposure unit of the image forming device is different in size from that for another of the different colors. However, the deviation compensation process using the conventional deviation compensation patterns performs the deviation compensation uniformly for all the colors. There is a problem in that the deviation compensation process using the conventional deviation compensation patterns includes an unnecessary compensation process, which is not efficient.

SUMMARY OF THE INVENTION

In one aspect of the invention, the present disclosure provides an improved deviation amount detecting device and method in which the above-described problems are eliminated.

In one aspect of the invention, the present disclosure provides a deviation amount detecting device which is able to detect the amount of deviation efficiently in a short time.

In an embodiment of the invention which solves or reduces one or more of the above-mentioned problems, the present disclosure provides a deviation amount detecting device which computes an amount of deviation for each of toner images of different colors in an electrophotographic color image forming device wherein a color image is formed on a transporting member by superimposing the toner images of different colors, the deviation amount detecting device including: an image formation unit configured to form on the transporting member a first set of deviation detecting patterns which are of different colors and of identical shape and superimposed at a same position in order to detect a deviation for each of multiple toner images of the different colors; a pattern reading unit configured to read the first set of deviation detecting patterns formed on the transporting member by the image formation unit; and a detection unit configured to detect whether a deviation for each of the toner images of the different colors on the transporting member takes place, based on position information which is stored as a result of the reading of the first set of deviation detecting patterns by the pattern reading unit.

DETAILED DESCRIPTION OF THE PREFERRED EMBODIMENTS

Figure 1:
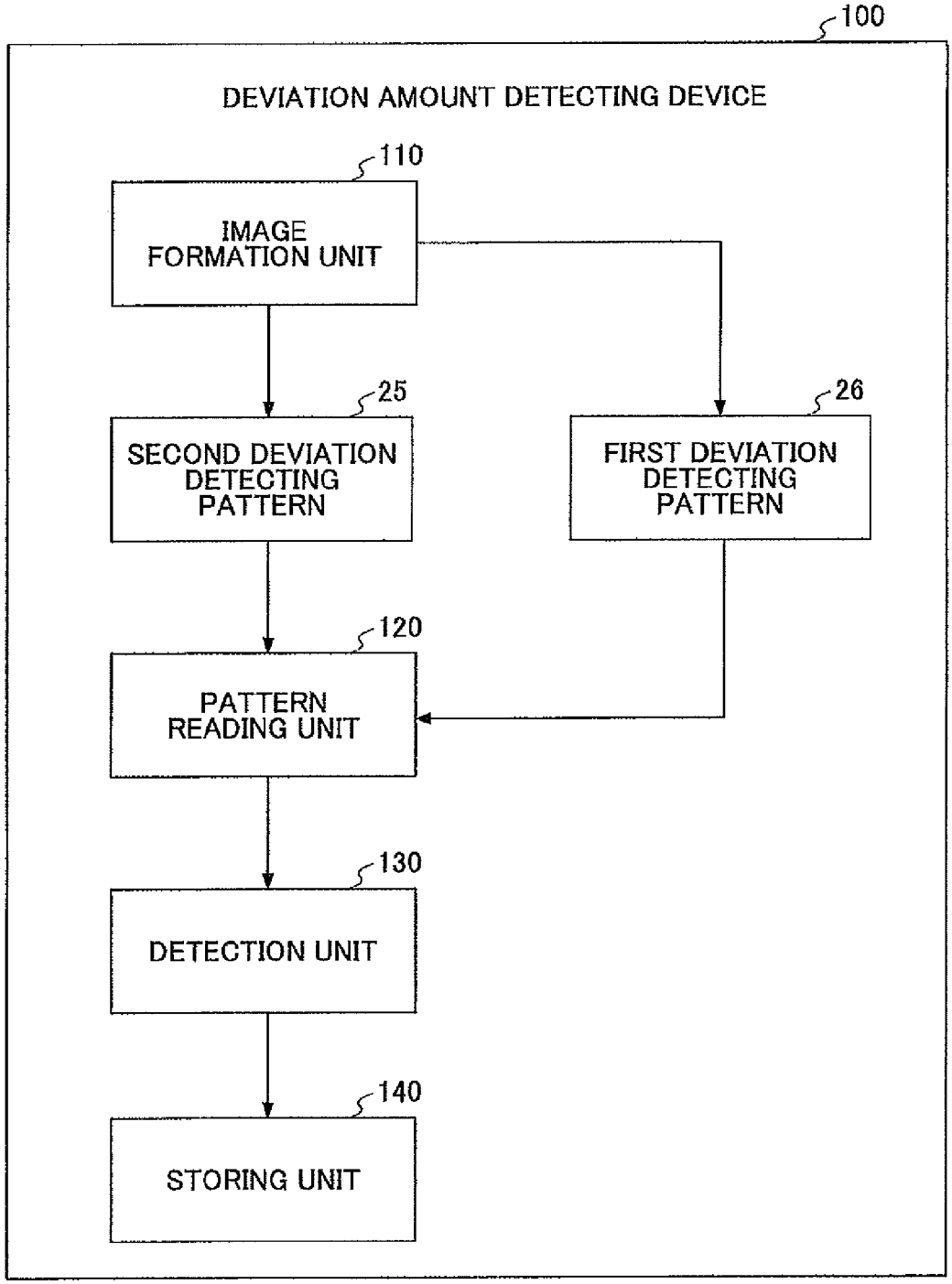
FIG. 1 is a block diagram showing the functional composition of a deviation amount detecting device of an embodiment of the invention.

A deviation amount detecting device of an embodiment of the invention computes an amount of deviation for each of multiple toner images of different colors in an electrophotographic color image forming device wherein a color image is formed on a transporting member by superimposing the toner images of different colors, the deviation amount detecting device including: an image formation unit configured to form on the transporting member a first set of deviation detecting patterns which are of different colors and of identical shape and superimposed at a same position in order to detect a deviation for each of toner images of the different colors; a pattern reading unit configured to read the first set of deviation detecting patterns formed on the transporting member by the image formation unit; and a detection unit configured to detect whether a deviation for each of the toner images of the different colors on the transporting member takes place, based on position information which is stored as a result of the reading of the first set of deviation detecting patterns by the pattern reading unit.

The above-mentioned deviation amount detecting device may be arranged so that the image formation unit is arranged to form on the transporting member a second set of deviation detecting patterns which are of different colors and of identical shape and arrayed in parallel without clearance in a transporting direction of the transporting member, the pattern reading unit is arranged to read the second set of deviation detecting patterns formed on the transporting member by the image formation unit, and the detection unit is arranged to detect whether a deviation for each of the toner images of the different colors on the transporting member takes place, based on position information which is stored as a result of the reading of the second set of deviation detecting patterns by the pattern reading unit.

The above-mentioned deviation amount detecting device may be arranged so that the first set of deviation detecting patterns are formed on the transporting member by laser beams which pass through lenses located at opposite positions around a center of a polygon mirror in an exposure unit of the image forming device and disposed in a vicinity of a drive motor which drives the polygon mirror.

The above-mentioned deviation amount detecting device may be arranged so that the lenses are two deflector lenses which are disposed in a vicinity of the polygon mirror in the exposure unit.

The above-mentioned deviation amount detecting device may be arranged so that the detection unit is arranged to compute an amount of deviation of an image of a second color among the colors of the second set of deviation detecting patterns from a position of an image of a first color among the colors of the second set of deviation detecting patterns, by using a detected value of a gap in the transporting direction between the image of the first color and the image of the second color.

A deviation amount detecting method of an embodiment of the invention is provided for use in a deviation amount detecting device which computes an amount of deviation for each of toner images of different colors in an electrophotographic color image forming device wherein a color image is formed on a transporting member by superimposing the toner images of different colors, the deviation amount detecting method including the step of: forming on the transporting member a first set of deviation detecting patterns which are of different colors and of identical shape and superimposed at a same position in order to detect a deviation for each of toner images of the different colors; reading the first set of deviation detecting patterns formed on the transporting member; and detecting whether a deviation for each of the toner images of the different colors on the transporting member takes place, based on position information which is stored as a result of the reading of the first set of deviation detecting patterns.

A computer-readable recording medium of an embodiment of the invention stores a deviation amount detecting program which, when executed by a computer, causes the computer to perform the above-mentioned deviation amount detecting method.

It is possible for the deviation amount detecting device of the embodiment of the invention to detect the amount of deviation efficiently in a short time.

Other objects, features and advantages of the present invention will become more apparent from the following detailed description when read in conjunction with the accompanying drawings.

A description will be given of embodiments of the invention with reference to the accompanying drawings.

FIG. 1 shows the functional composition of a deviation amount detecting device 100 of an embodiment of the invention. As shown in FIG. 1, the deviation amount detecting device 100 of this embodiment includes an image formation unit 110, a pattern reading unit 120, a detection unit 130, and a storing unit 140.

In the deviation amount detecting device 100, the pattern reading unit 120 reads deviation detecting patterns formed on a transporting member by the image formation unit 110, and the detection unit 130 detects an occurrence of deviation and computes an amount of deviation based on the reading results by the pattern reading unit 120.

In the following, the respective components of the deviation amount detecting device 100 will be explained.

Figure 2:
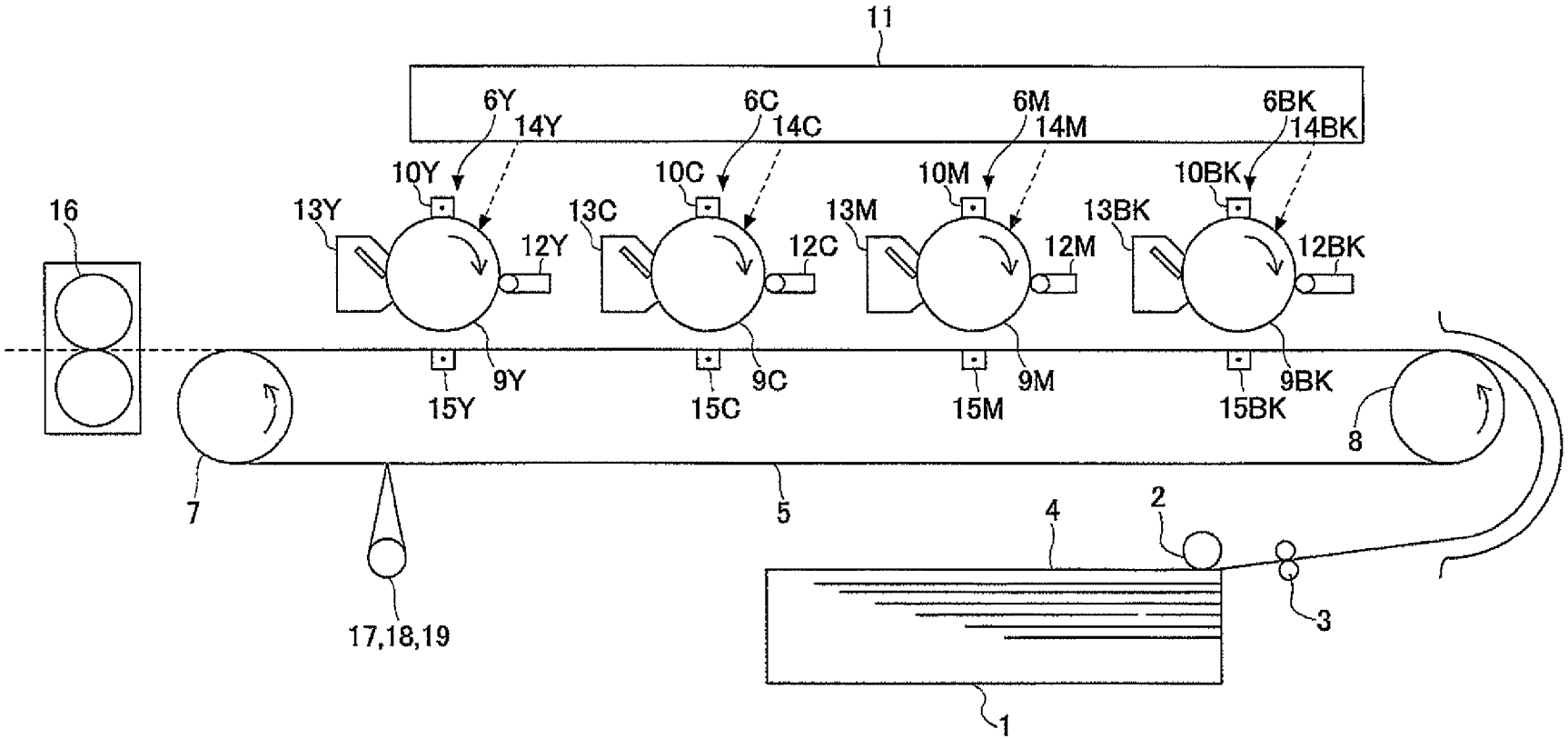
FIG. 2 is a diagram showing the composition of a color image forming device to which an embodiment of the invention is applied.

FIG. 2 shows the composition of a color image forming device to which an embodiment of the invention is applied. The image formation unit 110 of the deviation amount detecting device of this embodiment will be described with reference to FIG. 2.

The color image forming device shown in FIG. 2 is a tandem type electrophotographic image forming device. The deviation amount detecting device 100 is arranged for correcting an amount of deviation for each of multiple toner images of different colors formed by the tandem type electrophotographic image forming device. The deviation amount detecting device 100 uses an image formation unit that is the same as the image formation unit of the color image forming device. The composition and operation of the image formation unit of the color image forming device in this embodiment will be described.

As shown in FIG. 2, the color image forming device in this embodiment includes a paper tray 1, a feed roller 2, a separation roller 3, a recording sheet 4, a belt member (also called a transporting belt) 5, image formation units 6BK, 6M, 6C, BY, a driving roller 7, a driven roller 8, photoconductor drums 9BK, 9M, 9C, 9Y, charging units 10BK, 10M, 10C, 10Y, an exposure unit 11, developing units 12BK, 12M, 12C, 12Y, charge eliminating units 13BK, 13M, 13C, 13Y, transferring units 15BK, 15M, 15C, 15Y, a fixing unit 16, and sensors 17, 18, 19. Laser beams 14BK, and 14M, 14C and 14Y are the exposure beams of each image color.

As shown in FIG. 2, in the color image forming device in this embodiment, the image formation unit 6BK to form an image of black as a reference color and the image formation units 6M, 6C and 6Y to form images of other colors, which are magenta, cyan and yellow, are arranged in order along the endless-type transporting belt 5. Namely, the image formation units 6BK, 6M, 6C and 6Y are arranged along the transporting belt 5 (which transports a recording sheet 4 supplied from the paper tray 1 by the feed roller 2 and the separation roller 3) sequentially from the upstream side of the transporting belt 5 in the sub-scanning direction.

The image formation units 6BK, 6M, 6C and 6Y are arranged to form toner images of different colors (black, magenta, cyan, yellow) but have the same internal structure common to the respective image formation units. Therefore, in the following, only the composition and operation of the image formation unit 6BK will be described, and the description of the composition and operation of the image formation units 6M, 6C and 6Y that are the same as those of the image formation unit 6BK will be omitted.

The transporting belt 5 is an endless type belt which is wound between the driving roller 7 and the driven roller 8. The driving roller 7 is rotated by a drive motor (not shown). The drive motor, the driving roller 7 and the driven roller 8 function as a driving device which drives and moves the endless type transporting belt 5.

Upon starting image formation, the uppermost one of recording sheets 4 stored in the paper tray 1 is sequentially sent out, and the transporting belt 5 is rotated while the recording sheet 4 is attracted to the transporting belt 5 through an electrostatic attracting action, so that the recording sheet 4 is first transported to the image formation unit 6BK. At the image formation unit 6BK, a toner image of black is transferred from the photoconductor drum to the recording sheet 5.

The image formation unit 6BK includes a photoconductor drum 9BK as a photoconductor, and a charging unit 10BK, a developing unit 12BK, a photoconductor cleaner and a charge eliminating unit 13BK which are arranged around the photoconductor drum 9BK. The exposure unit 11 is arranged so that laser beams 14BK, 14M, 14C, 14Y, which correspond to the toner images of the colors formed by the image formation units 6BK, 6M, 6C, 6Y, are emitted to the photoconductor drum 9BK, 9M, 9C, 9Y, respectively.

Figure 3:
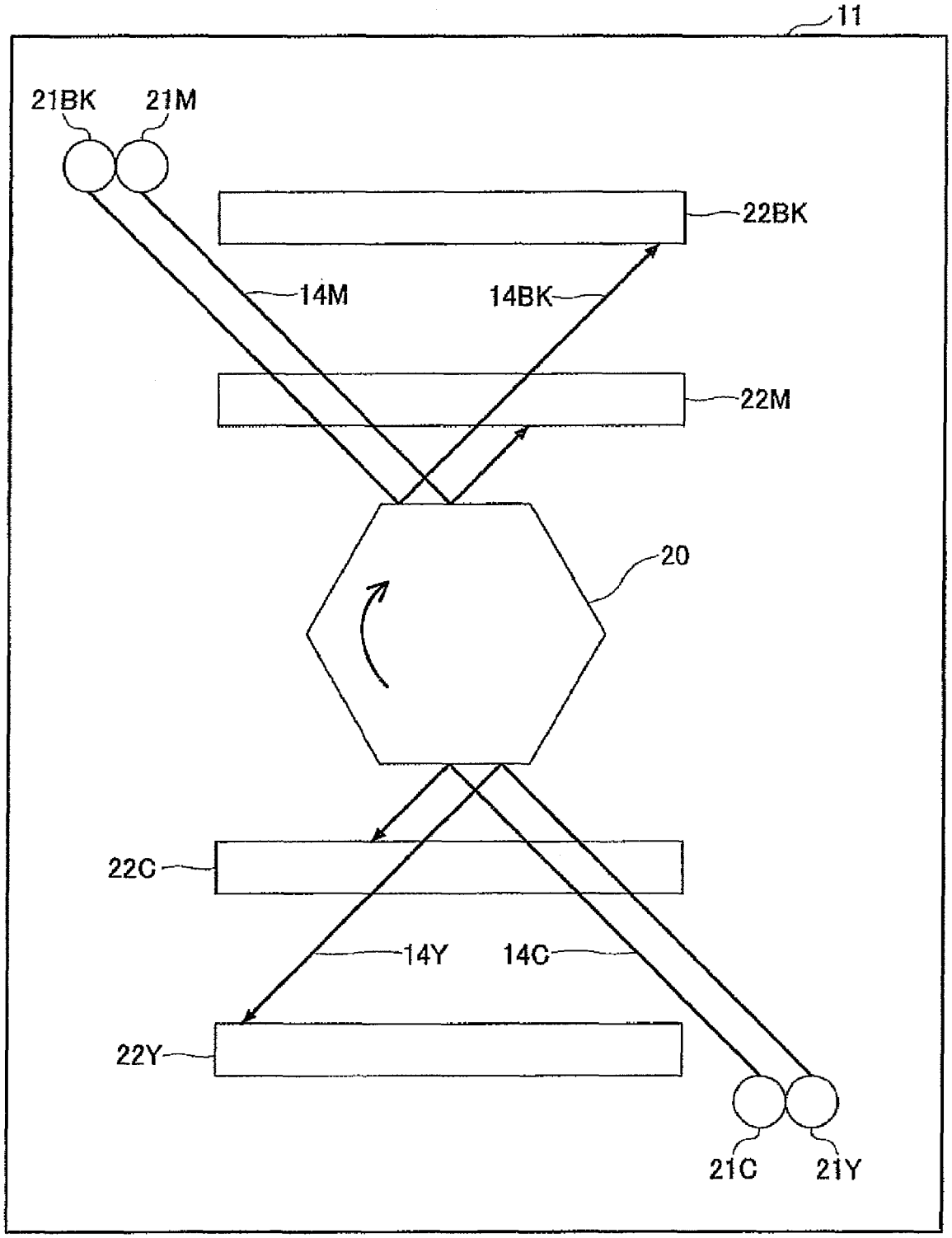
FIG. 3 is a diagram showing the internal structure of an exposure unit in an embodiment of the invention.

Next, the composition of an exposure unit 11 will be described with reference to FIG. 3. FIG. 3 shows the internal structure of an exposure unit 11.

In the exposure unit 11 shown in FIG. 3, laser beams 14BK, 14M, 14C, 14Y are respectively irradiated from laser diodes 21BK, 21M, 21C, 21Y which are light source units. The irradiated laser beams 14BK, 14M, 14C, 14Y are reflected by a reflector mirror 20 to pass through optical systems 22BK, 22M, 22C, 22Y, respectively. After each optical path is adjusted, the laser beams are delivered to scan the surfaces of the photoconductor drums 9BK, 9M, 9C, 9Y, respectively.

The reflector mirror 20 is a polygon mirror with six reflection surfaces. By rotating the reflector mirror 20, one main scanning line of each laser beam on the photoconductor drum in the main scanning direction is formed for one reflection surface of the polygon mirror. In this embodiment, a single polygon mirror is arranged for the four laser diodes as the light source units.

Specifically, the two laser beams 14BK, 14M and the two laser beams 14C, 14Y are separately reflected by the opposite reflection surfaces of the rotating polygon mirror, so that the four photoconductor drums can be simultaneously exposed to the laser beams. Each of the optical systems 22BK, 22M, 22C, 22Y includes an f-θ lens (deflector lens) which arranges the reflected light beams at equal intervals, and a deflector mirror which deflects each laser beam.

On the occasion of image formation, the outer surface of the photoconductor drum 9BK is uniformly charged by the charging unit 10BK in the dark, and the charged surface of the photoconductor drum 9BK is exposed to the laser beam 14BK (corresponding to the black image) delivered from the exposure unit 11, so that an electrostatic latent image is formed on the surface of the photoconductor drum 9BK. The developing unit 12BK visualizes this electrostatic latent image with black toner, so that a toner image of black is formed on the surface of the photoconductor drum 9BK.

This toner image is transferred to the recording sheet 4 by the transferring unit 15BK at the position (transfer position) where the photoconductor drum 9BK and the recording sheet 4 on transporting belt 5 are in contact. By this image transferring, the toner image of black is formed on the recording sheet 4.

The recording sheet 4 with the toner image of black transferred by the image formation unit 6BK as mentioned above is transported to the following image formation unit 6M by the transporting belt 5. In the image formation unit 6M, a toner image of magenta is formed on the photoconductor drum 9M through the image formation process that is the same as that in the image formation unit 6BK, and this toner image is superimposed and transferred to the toner image of black formed on the recording sheet 4.

The recording sheet 4 is further transported to the following image formation units 6C and 6Y, and a toner image of cyan formed on the photoconductor drum 9C and a toner image of yellow formed on the photoconductor drum 9Y are superimposed and transferred to the recording sheet 4 through the same operation.

In this manner, a full color image is formed on the recording sheet 4. After the recording sheet 4 with the full color image being formed is separated from the transporting belt 5, the image is fixed to the recording sheet 4 by the fixing unit 16, and the recording sheet 4 is ejected to the outside of the color image forming device.

In the color image forming device including the deviation amount detecting device 100 of this embodiment, a deviation between the toner images of respective colors may take place such that the toner images of respective colors are not superimposed at the same position. When such a deviation takes place, it is necessary to correct the deviation between the toner images of respective colors. It is assumed that this deviation correction in this embodiment is carried out by aligning the image position of each of the toner images of magenta, cyan, yellow to the image position of the toner image of black as the reference position. Alternatively, the deviation correction may be carried out by using the image position of the toner image of another color than black as the reference position.

Figure 4:
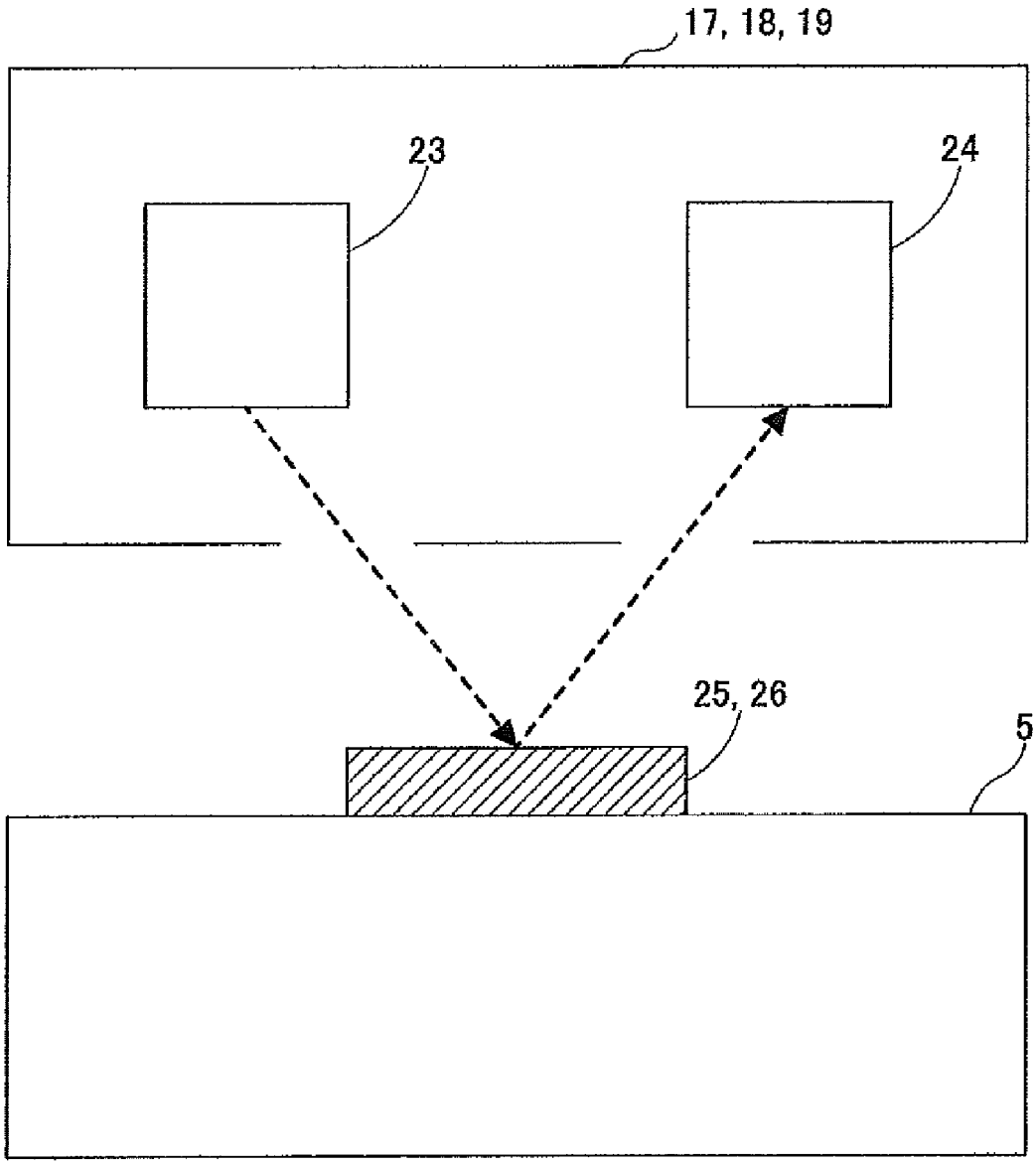
FIG. 4 is an enlarged diagram showing one of sensors in a pattern reading unit in an embodiment of the invention.

Next, the composition and operation of a sensor included in a pattern reading unit of a deviation amount detecting device 100 of an embodiment of the invention will be described with reference to FIG. 4 and FIG. 5. FIG. 4 is an enlarged diagram showing one of the sensors 17, 18 and 19, and FIG. 5 is a diagram showing the sensors 17, 18 and 19 included in the pattern reading unit.

As shown in FIG. 4, the sensor 17 (18, 19) includes a light emitting part 23 and a light receiving part 24. The light emitting part 23 emits an irradiation light to the transporting belt 5. The light receiving part 24 receives a reflected light from a deviation detecting pattern 26 formed on the transporting belt 5. The sensor 17 (18, 19) detects the deviation detecting pattern 26 from the received reflected light.

Figure 5:
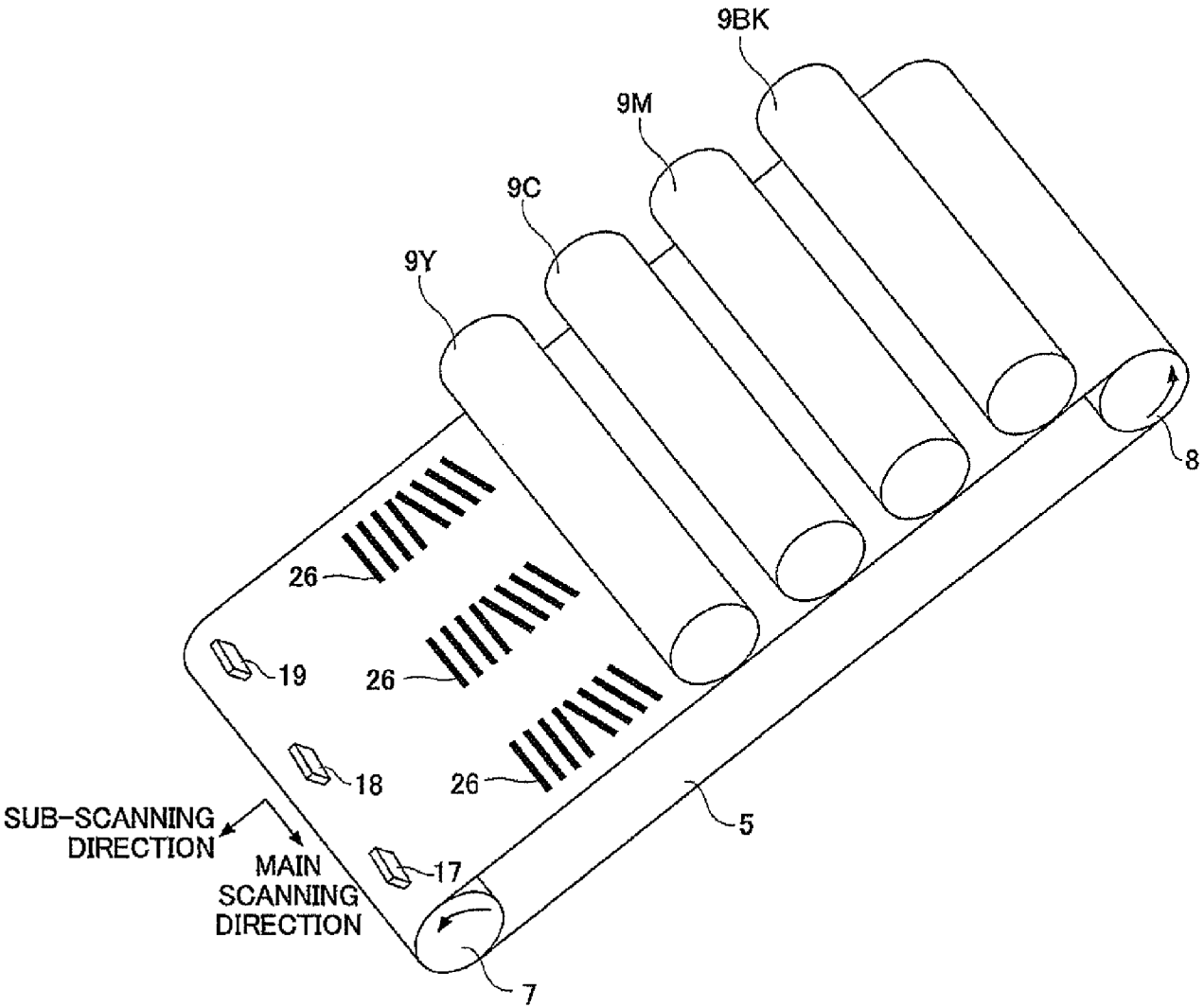
FIG. 5 is a diagram showing the sensors included in the pattern reading unit.

As shown in FIG. 5, the sensors 17, 18 and 19 are disposed on the downstream side of the image formation unit 6Y so that they face the transporting belt 5. The sensors 17, 18 and 19 are supported on the same substrate so that they are arranged in a line parallel to the main scanning direction.

Figure 6:
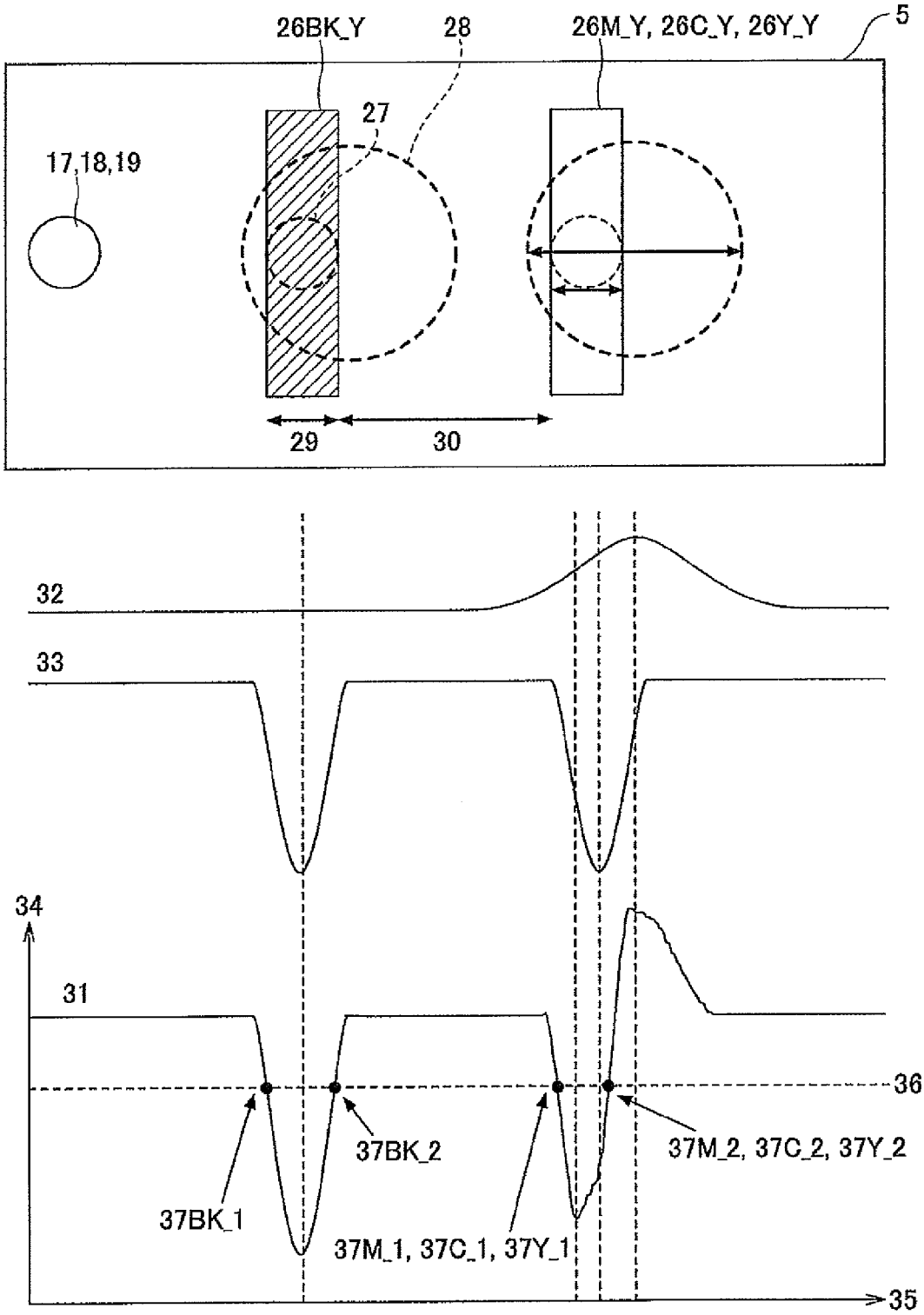
FIG. 6 is a diagram for explaining the principle of detecting deviation detecting patterns by one of the sensors included in the pattern reading unit.

Next, the principle of detecting the deviation detecting patterns will be described with reference to FIG. 6. FIG. 6 is a diagram for explaining the principle of detecting the first deviation detecting patterns 26 by the sensor 17 (18, 19).

In FIG. 6, the curve 31 denotes the detection result of reflected light received by the light receiving part 24, the curve 32 denotes the detection intensity of diffuse reflected light received by the light receiving part 24, and the curve 33 denotes the detection intensity of normal reflected light received by the light receiving part 24. The detection result (the curve 31) of reflected light received by the light receiving part 24 is equal to the sum of the detection intensity (the curve 32) of diffuse reflected light received by the light receiving part 24 and the detection intensity (the curve 33) of normal reflected light received by the light receiving part 24.

The vertical axis 34 in FIG. 6 indicates the light receiving intensity of the light receiving part 24, and the horizontal axis 35 indicates the elapsed time. The normal reflected light means reflected light which is reflected in the direction opposite to the incidence direction and at the angle that is the same as the incident angle of an incident light (namely, the angle of reflection of the reflected light is indicated by ($\pi$-$\theta$) where the incident angle is set to $\theta$), and the diffuse reflected light means reflected light other than the normal reflected light.

In FIG. 6, reference numeral 36 denotes a predetermined threshold of the light receiving part 24 of the sensor 17 (18, 19). As shown in FIG. 6, the sensor 17 (18, 19) detects an edge of the deviation detecting pattern 26 at each of positions 37BK_1, 37BK_2, 37M_1 (37C_1, 37Y_1) and 37M_12 (37C_2, 37Y_2) where the detection result 31 of the reflected light intersects the line indicated by the threshold 36. In this embodiment, the middle point of two edges detected from each of the deviation detecting patterns 26 (for example, the middle point of 37BK_1 and 37BK_2) is determined as being an image position of the pattern.

Alternatively, any of edges 37BK_1, 37BK_2, 37M_1 (37C_1, 37Y_1) and 37M_2 (37C_2, 37Y_2) detected from each of the deviation detecting patterns 26 may be determined as being an image position of the pattern.

In order to improve a S/N ratio (the ratio of the intensity of a signal to be detected to the intensity of the noise) at the time of detecting the deviation detecting patterns, it is necessary that the line width 29 of each of the deviation detecting patterns in the sub-scanning direction be nearly equal to a width of the light receivable region 27 (the spot diameter of the photo diode) of the light receiving part 24.

Diffuse light beams are simultaneously reflected from two patterns if irradiation light is emitted to two deviation detecting patterns simultaneously. In such a case, it is impossible to detect one pattern normally. To avoid this, it is necessary to set the distance 30 between two deviation detecting patterns to be larger than the spot diameter 28 of the irradiation light.

Figure 7:
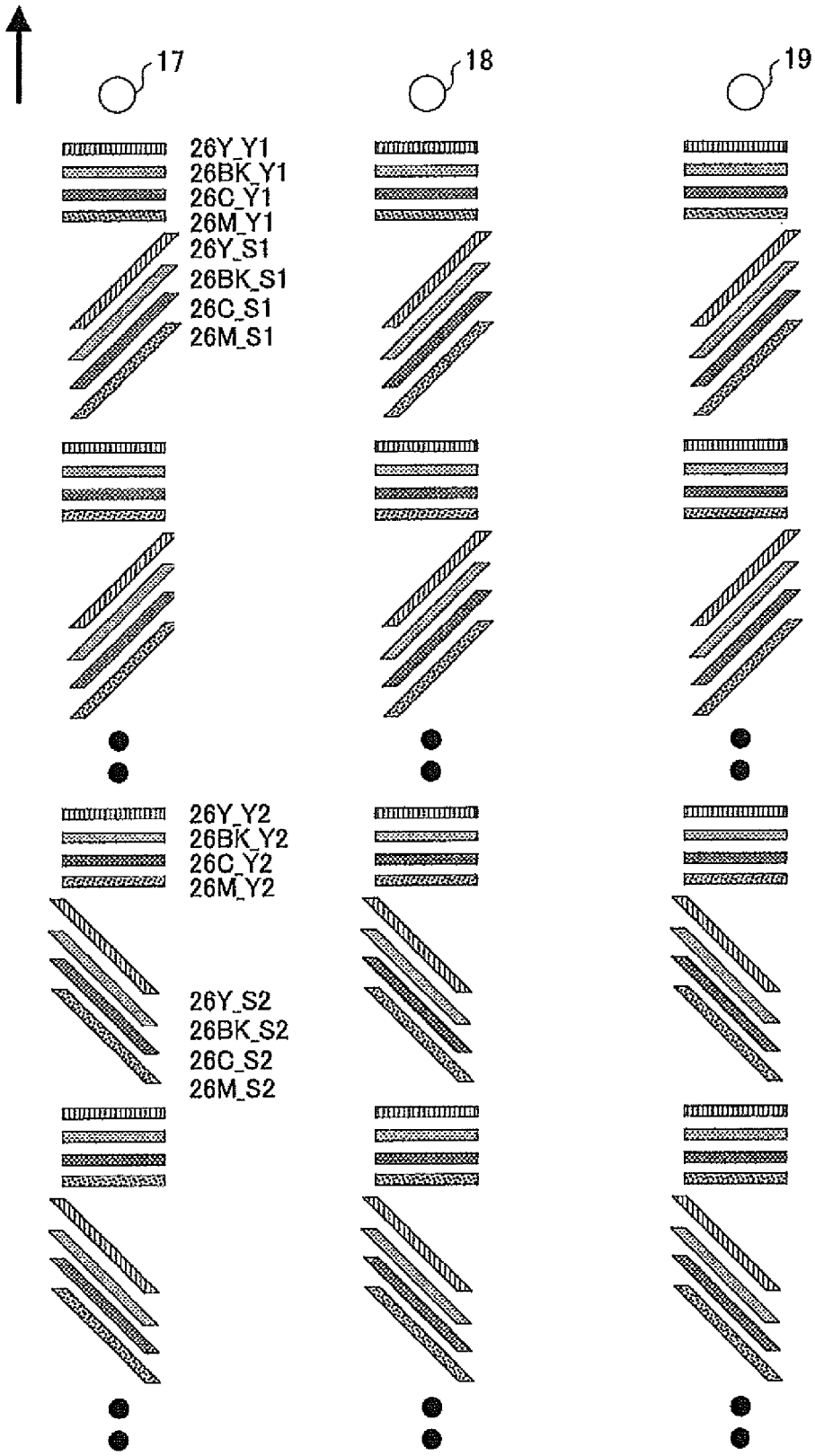
FIG. 7 is a diagram showing an example of first deviation detecting patterns in an embodiment of the invention.

Next, the first deviation detecting patterns will be described with reference to FIG. 7. FIG. 7 is a diagram showing an example of the first deviation detecting patterns 26 in an embodiment of the invention.

As shown in FIG. 7, the first deviation detecting patterns 26 are formed of four colors of black, magenta, cyan and yellow. The first deviation detecting patterns 26 include various sets of deviation detecting patterns, each set including combinations of: four straight line deviation detecting patterns (26BK_Y1, 26M_Y1, 26C_Y1, 26Y_Y1) which are parallel to the main scanning direction; four slanting line deviation detecting patterns (26BK_S1, 26M_S1 26C_S1, 26Y_S1) having an inclination angle of $\pi/4$ (45°) to the main scanning direction; four straight line deviation detecting patterns (26BK_Y2, 26M_Y2, 26C_Y2, 26Y_Y2) which are parallel to the main scanning direction; and four slanting line deviation detecting patterns (26BK_S2, 26M_S2, 26C_S2, 26Y_S2) having an inclination angle of $3\pi/4$ (135°) to the main scanning direction.

The intervals between the sets of the deviation detecting patterns in the sub-scanning direction may be equal to one third of the length of the outer circumference of each of the photoconductor drums 9BK, 9M, 9C and 9Y, and may be equal to one half of the length of the outer circumference of the driving roller 7.

Among the first deviation detecting patterns 26 mentioned above, three sets of first deviation detecting patterns 26 may be formed over one cycle of each photoconductor drum 9, and fluctuations of the amount of deviation due to the unevenness of the rotation of each photoconductor drum 9 can be canceled by averaging the amounts of deviation detected. Similarly, two sets of first deviation detecting patterns 26 may be formed over one cycle of the driving roller 7.

The deviation amount detecting device 100 of this embodiment is arranged to form 24 sets of the first deviation detecting patterns 26 along the sub-scanning direction, each set combining the eight straight light deviation detecting patterns, the four slanting line deviation detecting patterns with an inclination angle of $\pi/4$ and the four slanting line deviation detecting patterns with an inclination angle of $3\pi/4$. The total length of the thus formed first deviation detecting patterns 26 may be equal to the peripheral length of the transporting belt 5, and the detection error due to the unevenness of the thickness of the transporting belt 5 may be canceled.

Among the 24 sets of first deviation detecting patterns 26 shown in FIG. 7, the first half of the 12 sets contain only the slanting line deviation detecting patterns, and the second half of the 12 sets contains only the slanting line deviation detecting patterns. The interval of the 12 sets of the first half in the sub-scanning direction may be equal to that of the 12 sets of the second half, and the cycle of the 12 sets of both in the sub-scanning direction may be equal to four cycles of the photoconductor drum 9, and may be equal to six cycles of the driving roller 7.

The sets containing the slanting line deviation detecting patterns are formed continuously over more than one cycle of the photoconductor drum 9 and the driving roller 7, the rotation unevenness can be offset by the use of the respective sets containing the slanting line deviation detecting patterns.

In the deviation amount detecting device 100 of this embodiment, the first deviation detecting patterns 26 are formed as toner images of black, magenta, cyan and yellow on the transporting belt 5 through the printing process that is the same as the previously described printing process of forming a color image on the recording sheet 4. The image formation unit 110 in this embodiment may constitute the image formation units 6BK, 6M, 6C and 6Y used in the color image forming device.

Figure 8:
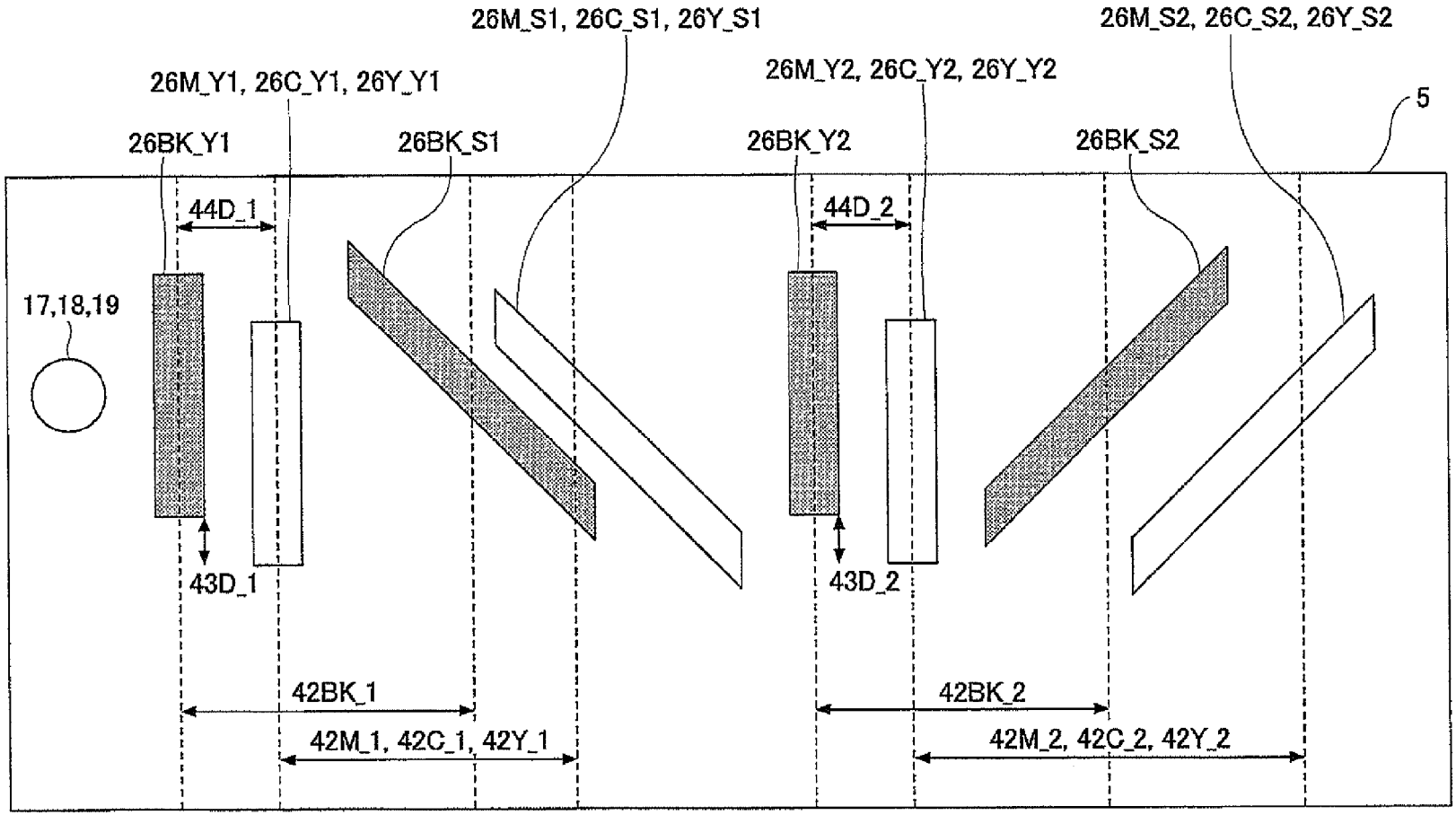
FIG. 8 is a diagram for explaining the principle of computing an amount of deviation using the first deviation detecting patterns.

Next, the computation of the amount of deviation using the first deviation detecting patterns will be described with reference to FIG. 8. FIG. 8 is a diagram for explaining the principle of computing the amount of deviation using the first deviation detecting patterns.

In the example shown in FIG. 8, the amount of deviation for the image of magenta is computed from the first deviation detecting patterns 26 of black and magenta by setting the image of black as a reference image. Similarly, if the first deviation detecting pattern of magenta is replaced by one of the first deviation detecting patterns of cyan and yellow, the amount of deviation for the image of cyan or yellow with respect to the image of black as the reference image can be computed.

In FIG. 8, a sensor 17 (18, 19), straight line deviation detecting patterns 26BK_Y1, 26BK_Y2 of black, straight line deviation detecting patterns 26M_Y1, 26M_Y2 of magenta, a slanting line deviation detecting pattern 26BK_S1 of black, a slanting line deviation detecting pattern 26M_S1 of magenta, a slanting line deviation detecting pattern 26BK_S2 of black, and a slanting line deviation detecting pattern 26M_S2 of magenta are illustrated. The arrow 42BK_1 in FIG. 8 denotes a distance between the straight line deviation detecting pattern 26BK_Y1 of black and the slanting line deviation detecting pattern 26BK_S1 of black. The arrow 42BK_2 in FIG. 8 denotes a distance between the straight line deviation detecting pattern 26BK_Y2 of black and the slanting line deviation detecting pattern 26BK_S2 of black. The arrow 42M_1 in FIG. 8 denotes a distance between the straight line deviation detecting pattern 26M_Y1 of magenta and the slanting line deviation detecting pattern 26M_S1 of magenta. The arrow 42M_2 in FIG. 8 denotes a distance between the straight line deviation detecting patterns 26M_Y2 of magenta and the slanting line deviation detecting pattern 26M_S2 of magenta.

It is assumed that the position of each deviation detecting pattern needed for computing the distance between the above-mentioned deviation detecting patterns is the midpoint between the front-end edge and the rear-end edge of each detecting pattern which is detected by the sensor 17.

The deviation amounts 43D_1 and 43D_2 of the main scanning direction computed from the respective deviation detecting patterns are represented by the formulas: 43D_1=42BK_1−42M_1 and 43D_2=42M_2−42BK_2 because the inclination angles to the main scanning direction of the slanting line deviation detecting pattern 26M_S1 of magenta and the slanting line deviation detecting pattern 26M_S2 of magenta are equal to $\pi/4$ and $3\pi/4$, respectively.

The deviation amount 43D of the main scanning direction of the magenta image to the black image is represented by the average of 43D_1 and 43D_2: 43D=(43D_1+43D_2)/2. The deviation amount 44D of the sub-scanning direction of the magenta image to the black image is determined by computing a difference between the detection value 44D_1 (44D_2) of the distance of the straight line deviation detecting pattern 26BK_Y1 of black and the straight line deviation detecting pattern 26M_Y1 of magenta and the desired distance (to be originally created by the deviation amount detecting device 100) of the straight line deviation detecting pattern 26BK_Y1 of black and the straight line deviation detecting pattern 26M_Y1 of magenta.

Next, the computation of the amount of deviation using the second deviation detecting patterns 25 will be described.

Figure 9A:
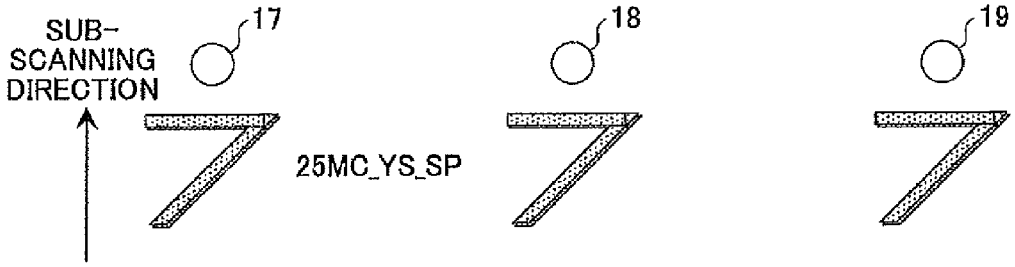
FIG. 9A, FIG. 9B and FIG. 9C are diagrams showing an example of second deviation detecting patterns in an embodiment of the invention.

The image formation unit 110 in one embodiment of the invention is arranged to form on the transporting belt 5 the second deviation detecting patterns 25 which are of different colors and of identical shape and are superimposed at a same position (see FIG. 9A). The image formation unit 110 in another embodiment of the invention is arranged to form on the transporting belt 5 the second deviation detecting patterns 25 which are of different colors and of identical shape and are arrayed in parallel without clearance in the transporting direction of the transporting belt 5 (see FIG. 10A).

The colors of the second deviation detecting patterns 25 include at least two colors, and the laser beams corresponding to these colors penetrate the f-θ lenses (for example, the elements 22M and 22C in FIG. 3) located at opposite positions around the center of the polygon mirror 20 in the exposure unit 11 and disposed in the vicinity of the drive motor which drives the polygon mirror 20. The optical systems including the f-θ lenses which are penetrated by the laser beams corresponding to these colors are disposed in the vicinity of the drive motor which drives the polygon mirror 20, and the optical systems are easily influenced by the heat generated in the drive motor. Thus, the toner images of these colors may easily deviate from the desired portion due to the thermal influence and it is necessary to correct the deviation of the toner images of these colors.

The pattern reading unit 120 reads the second deviation detecting patterns 25 formed on the transporting belt 5 by the image formation unit 110. The result of reading of the second deviation detecting patterns 25 by the pattern reading unit 120 is stored in the storage device as the position information for the second deviation detecting patterns 25.

The detection unit 130 detects occurrence of deviation and the amount of deviation using the position information concerning the second deviation detecting patterns 25 stored in the storage device.

Specifically, when the second deviation detecting patterns 25 which are of different colors and of identical shape and superimposed at the same position are formed on the transporting belt 57 the detection unit 130 detects a line width of each pattern 25 in the transporting direction of the transporting belt 5 (the sub-scanning direction) based on the stored position information, and determines whether the deviation for each color image takes place. Alternatively, when the second deviation detecting patterns 25 which are of different colors and of identical shape and arrayed in parallel without clearance in the sub-scanning direction (or in the transporting direction of the transporting belt 5) are formed on the transporting belt 5, the detection unit 130 detects a line width of each pattern 25 in the sub-scanning direction and a gap between the respective color images, based on the stored position information, and then determines whether the deviation for each color image takes place, and computes an amount of deviation for each color image.

Next, the second deviation detecting patterns 25 in the embodiments of the invention will be described with reference to FIGS. 9A to 9C and FIGS. 10A to 10C, respectively.

As shown in FIG. 9A, each of two second deviation detecting patterns 25MC_YS_SP of magenta and cyan in this embodiment has an identical shape and includes a straight line pattern parallel to the main scanning direction and a slanting line pattern having a predetermined inclination angle to the main scanning direction, and the straight line pattern and the slanting line pattern are connected to each other. These patterns 25MC_YS_SP are superimposed at the same position on the transporting belt 5. One set of these second deviation detecting patterns 25MC_YS_SP is formed in the sub-scanning direction on the transporting belt 5.

By detecting the deviation of each color image using the second deviation detecting patterns 25, it is possible to detect the occurrence of the deviation efficiently in a short time. Moreover, by using the result of the detection, it is possible to determine the timing to start performing the deviation compensation process using the first deviation detecting patterns 26 which process provides a comparatively high level of accuracy of deviation amount computation but requires a comparatively long processing time. Accordingly, it is possible to maintain the frequency at which the deviation compensation process is performed at an appropriate level.

As shown in FIG. 3, in this embodiment, the optical systems, including the f-θ lenses which are penetrated by the laser beams of magenta and cyan, are disposed at opposite positions around the center of the polygon mirror 20 in the exposure unit 11, and the deviation of the toner images of these colors is influenced by a rise of the temperature of the exposure unit 11 more significantly than in the case of the laser beams of black and yellow.

Figure 9B:
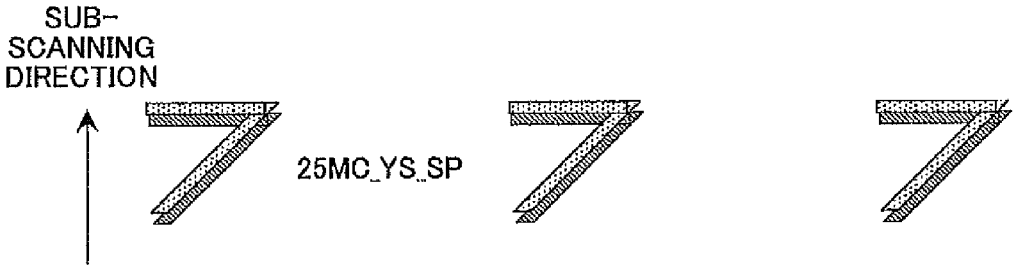
Figure 9C:
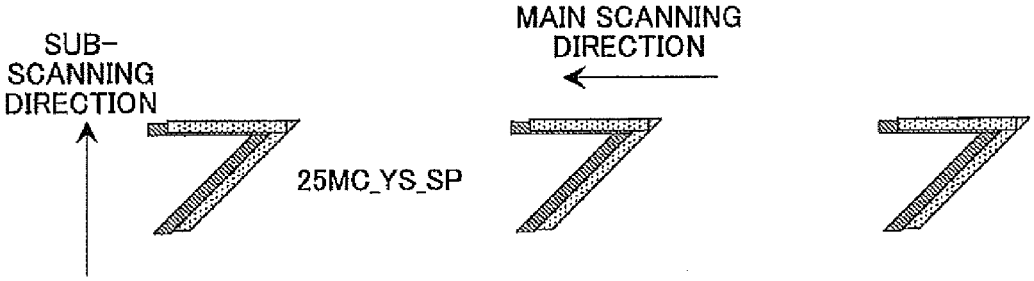

When the image of magenta or the image of cyan deviates in the sub-scanning direction, the line width of the second deviation detecting patterns 25MC_YS SP in the sub-scanning direction increases (see FIG. 9B). Therefore, the detection unit 130 of this embodiment detects the line width of the second deviation detecting patterns 25MC_YS_SP, and determines whether the deviation of the image of each color takes place based on the detected line width.

Specifically, the detection unit 130 determines that the deviation of either of the images of magenta and cyan takes place, when the detected line width of the second deviation detecting patterns 25MC_YS_SP in the sub-scanning direction exceeds a given reference value.

When the image of magenta or cyan deviates in the sub-scanning direction, the line width of each of the straight line pattern and the slanting line pattern in the second deviation detecting patterns 25MC_YS_SP in the sub-scanning direction increases (see FIG. 9B). On the other hand, when the image of magenta or cyan deviates in the main scanning direction, only the line width of the slanting line pattern in the sub-scanning direction increases (see FIG. 9C). By using these features, the detection unit 130 determines the direction in which the deviation occurs.

Alternatively, in another example of the second deviation detecting patterns 25MC_YS_SP, each pattern 25MC_YS_SP may include only one of a straight line pattern and a slanting line pattern.

Figure 10A:
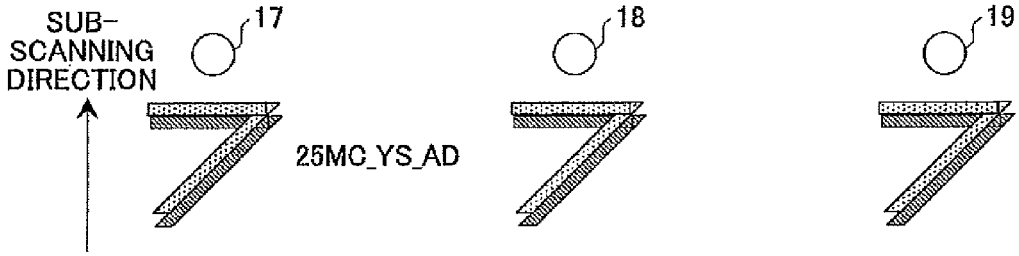
FIG. 10A, FIG. 10B and FIG. 10C are diagrams showing an example of second deviation detecting patterns in an embodiment of the invention.

Next, as shown in FIG. 10A, each of two second deviation detecting patterns 25MC_YS_AD of magenta and cyan in another embodiment of the invention has an identical shape and includes a straight line pattern parallel to the main scanning direction and a slanting line pattern having a predetermined inclination angle to the main scanning direction, and the straight line pattern and the slanting line pattern are connected to each other. These patterns 25MC_YS_AD are arrayed in parallel without clearance in the sub-scanning direction on the transporting belt 5. In this embodiment, one set of these second deviation detecting patterns 25MC_YS_AD is formed in the sub-scanning direction on the transporting belt 5.

By using the second deviation detecting patterns 25 shown in FIG. 10A, the deviation amount detecting device 100 of this embodiment detects the deviation of each color image, and it is possible to detect the occurrence of the deviation efficiently in a short time. Moreover, by using the result of the detection, it is possible to determine the timing to start performing the deviation compensation process using the first deviation detecting patterns 26, which process provides a comparatively high level of accuracy in the deviation amount computation but requires a comparatively long processing time. Accordingly, it is possible to maintain the frequency at which the deviation compensation process is performed at an appropriate level.

Similar to the second deviation detecting patterns 25MC_YS_SP shown in FIG. 9A, the second deviation detecting patterns 25MC_YS_AD of this embodiment may be formed of two different colors of magenta and cyan as described above.

Figure 10B:
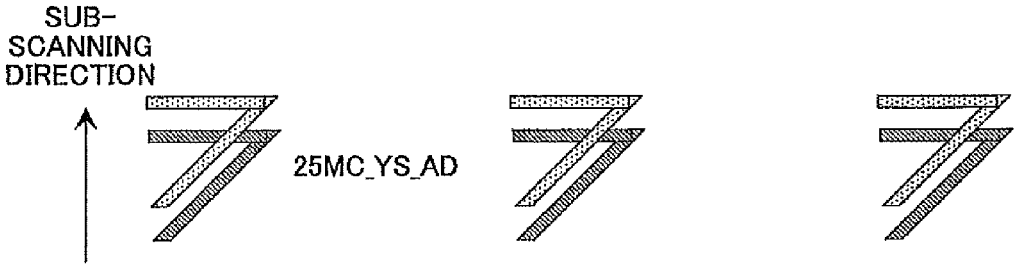
Figure 10C:
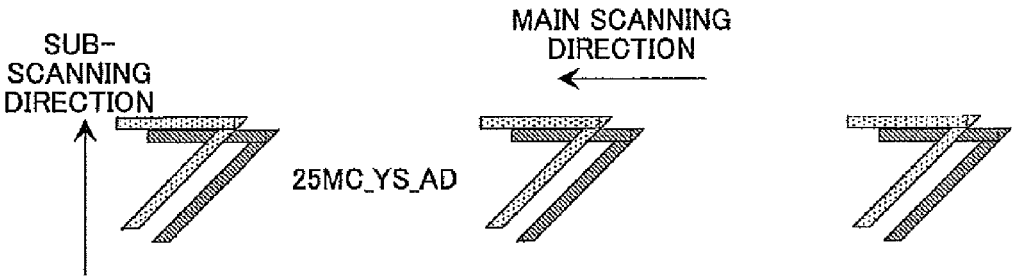

When the image of magenta or the image of cyan deviates, the line width of the second deviation detecting patterns 25MC_YS_AD in the sub-scanning direction decreases or a gap between the image of magenta and the image of cyan is produced (see FIG. 10B). Therefore, the detection unit 130 of this embodiment detects the line width or gap of the second deviation detecting patterns 25MC_YS_AD, and determines whether the deviation of the image of each color takes place based on the detected line width or gap.

Specifically, the detection unit 130 determines that the deviation of either of the images of magenta and cyan takes place, when the detected line width or gap of the second deviation detecting patterns 25MC_YS_AD in the sub-scanning direction exceeds a given reference value.

When the image of magenta or cyan deviates in the sub-scanning direction, both a gap between the straight line patterns of the second deviation detecting patterns 25MC_YS_AD and a gap between the slanting line patterns of the second deviation detecting patterns 25MC_YS_AD are produced (see FIG. 10B). On the other hand, when the image of magenta or cyan deviates in the main scanning direction, only a gap between the slanting line patterns of the second deviation detecting patterns 25MC_YS_AD is produced (see FIG. 10C). By using these features of the second deviation detecting patterns 25MC_YS_AD, the detection unit 130 determines the direction in which the deviation occurs.

When a gap between the image of magenta and the image of cyan is produced, the detection unit 130 detects the gap by using the second deviation detecting patterns 25MC_YS_AD. By detecting the gap in such a case, the detection unit 130 is able to compute the amount of deviation of one of the images of magenta and cyan from the other of the images of magenta and cyan as the reference color image.

In computing the deviation amount, the amount of deviation of the sub-scanning direction is equal to the value of the gap between the straight line patterns of the second deviation detecting patterns 25MC_YS_AD. The amount of deviation of the main scanning direction is computed by using the value of the gap between the slanting line patterns of the second deviation detecting patterns 25MC_YS_AD. Specifically, when the inclination angle of the slanting line patterns to the main scanning direction is equal to $\pi/4$, the amount of deviation of the main scanning direction is equal to the value of the gap between the slanting line patterns.

Since the lenses penetrated by the laser beams of magenta and cyan are disposed at the opposite positions around the center of the polygon mirror 20 in the exposure unit 11, the direction in which the image of magenta deviates and the direction in which the image of cyan deviates are opposite to each other in the sub-scanning direction. If the second deviation detecting patterns 25MC_YS_AD are formed using this feature, a gap between the image of magenta and the image of cyan is easily produced, and it is possible to detect this gap.

In another example of the second deviation detecting patterns 25MC_YS_AD, each pattern 25MC_YS_AD may include only one of a straight line pattern and a slanting line pattern.

Alternatively, second deviation detecting patterns 25 of black which have an identical shape to that of the second deviation detecting patterns 25MC_YS_AD may be arranged in parallel with the second deviation detecting patterns 25MC_YS_AD. In such a case, the image of black as the image of the reference color may be formed, and the amount of deviation of each of the images of magenta and cyan from the image of black may be computed.

Alternatively, the second deviation detecting patterns 25MC_YS_AD may be formed on the transporting belt, so that the straight line patterns and the slanting line patterns of the two colors of magenta and cyan are connected to each other and arrayed in parallel without clearance in the transporting direction of the transporting belt, and that the image of one color is interposed between the images of the other color.

In this embodiment, the above-mentioned transporting belt 5 may be an intermediate transfer belt. In such a case, the image formation unit 110 is arranged to form the first and second deviation detecting patterns 25 and 26 on the intermediate transfer belt.

Next, the composition and operation of a detection unit 130 in a deviation amount detecting device of an embodiment of the invention will be described with reference to FIG. 11.

Figure 11:
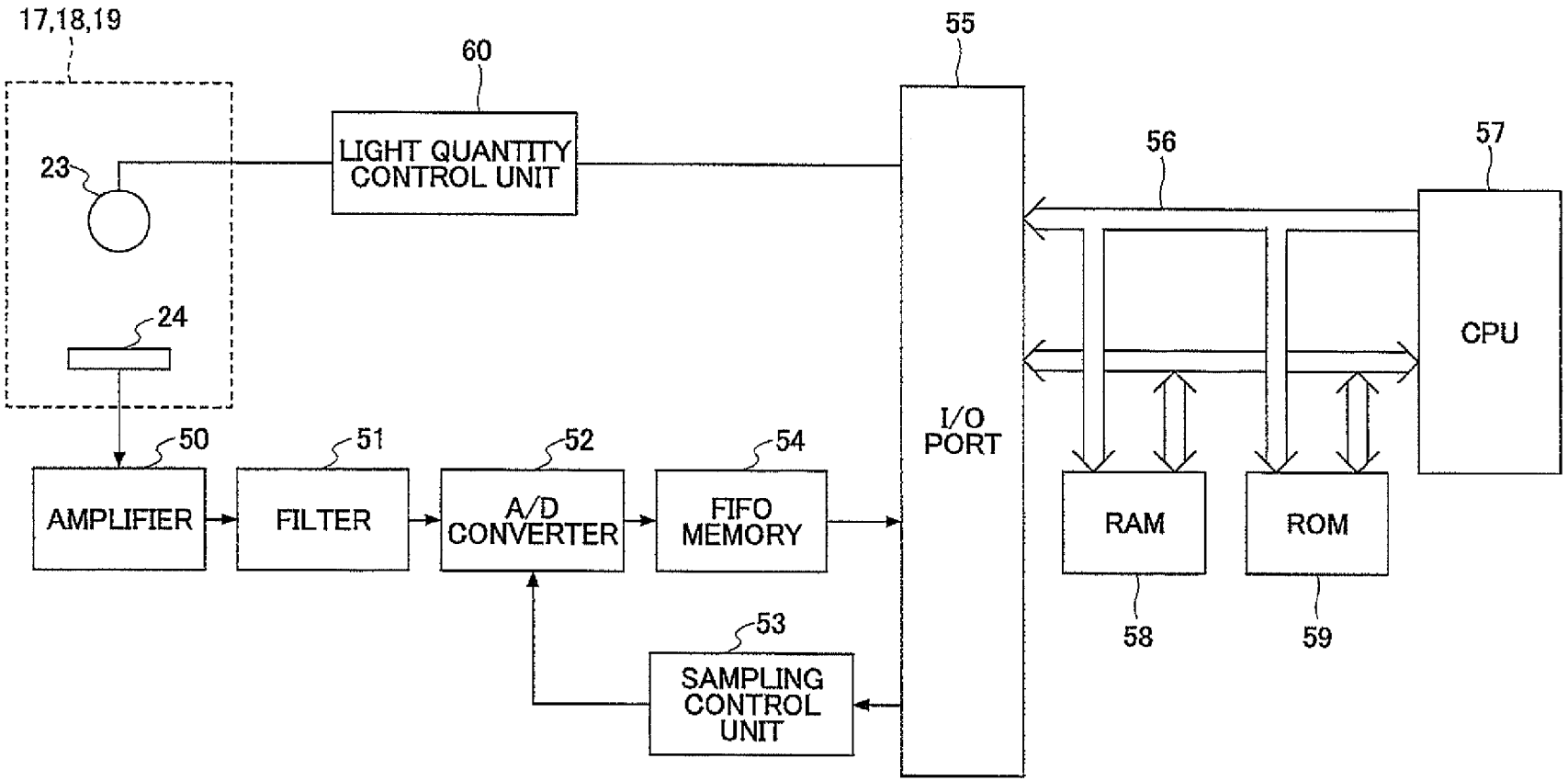
FIG. 11 is a diagram showing the composition of a detection unit of a deviation amount detecting device of an embodiment of the invention.

As shown in FIG. 11, the detection unit 130 in this embodiment includes an amplifier 50, a filter 51, an A/D (analog-to-digital) converter 52, a sampling control unit 53, a FIFO (first-in first-out) memory 54, an I/O (input/output) port 55, a data bus 56, a CPU (central processing unit) 57, a RAM (random access memory) 58, a ROM (read-only memory) 59, and a light quantity control unit 60.

The signal of reflected light received by the light receiving part 24 is amplified by the amplifier 50. Only the signal component needed for detecting the deviation detecting patterns 25 or 26 is extracted from the amplified signal using the filter 51.

Next, the signal component of the reflected light signal from the filter 51 is converted from analog data into digital data by the A/D converter 52. The sampling of the data in this A/D conversion is controlled by the sampling control unit 53, and the sampled signal is stored in the FIFO memory 54.

After the detection of the deviation detecting patterns 25 or 26 of all the four colors of black, magenta, cyan and yellow is completed, the data stored in the FIFO memory 54 is loaded to the RAM 58 via the I/O port 55 and the data bus 56. The CPU 57 performs data processing in which the above-described computation of the amount of deviation is carried out with respect to the data loaded to the RAM 58.

In the ROM 59, the program for performing the above-described computation of the amount of deviation and the various programs for controlling the deviation amount detecting device of this embodiment are stored beforehand. The CPU 57 monitors the detection signal from the light receiving part 24 at an appropriate time, and controls the light quantity by using the light quantity control unit 60, so that the intensity of the light receiving signal from the light receiving part 24 is maintained at a fixed level, in order to accurately detect the deviation amount even if degradation of the transporting belt 5 and the light emitting part 23 takes place. Thus, the CPU 57 and the ROM 59 function as a control unit which controls operation of the entire deviation amount detecting device 100 of this embodiment.

Figure 12:
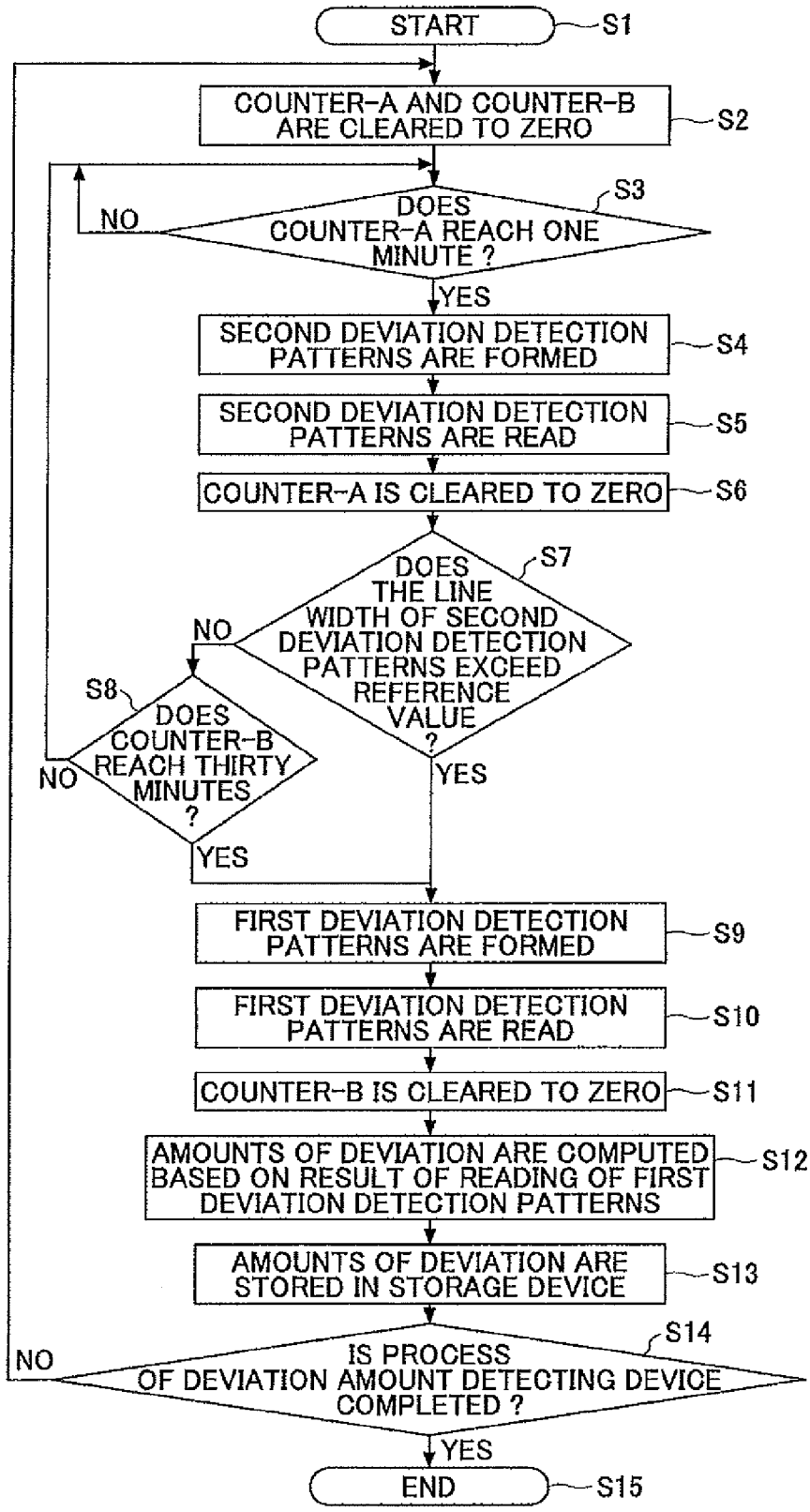
FIG. 12 is a flowchart for explaining the process of computation of the amount of deviation by a deviation amount detecting device of an embodiment of the invention.

Next, the process of computation of the amount of deviation by a deviation amount detecting device of an embodiment of the invention will be described. FIG. 12 is a flowchart for explaining the process of computation of the amount of deviation by a deviation amount detecting device of this embodiment.

In the process of computation of the amount of deviation by the deviation amount detecting device 100 of this embodiment, it is detected whether a deviation for each image of magenta and cyan takes place, by using the second deviation detecting patterns 25MC_YS_SP shown in FIG. 9A. When it is detected that the deviation takes place, the deviation amount detecting device 100 of this embodiment computes the amounts of deviation of the main scanning direction and the sub-scanning direction of each color image of magenta, cyan and yellow from the position of an image of black as a reference color image, by using the first deviation detecting pattern 26.

In the flowchart of FIG. 12, the process of the deviation amount detecting device 100 of this embodiment is started at step S1.

In step S2, an execution cycle counter-A of the process of detection of the deviation using the second deviation detecting patterns 25 and an execution cycle counter-B of the process of computation of the amounts of deviation using the first deviation detecting patterns 26 are cleared to zero. It is assumed that, in this embodiment, an execution cycle of the process of detection of the deviation using the second deviation detecting patterns 25 is set to 1 minute, and an execution cycle of the process of computation of the amounts of deviation using the first deviation detecting patterns 26 is set to 30 minutes.

In step S3, it is detected whether the execution cycle counter-A reaches 1 minute. When the execution cycle counter-A reaches 1 minute in step S3, the image formation unit 110 forms the second deviation detecting patterns 25MC_YS_SP as shown in FIG. 9A on the transporting belt 5 in step S4.

When the execution cycle counter-A does not reach 1 minute in step S3, the deviation amount detecting device 100 is set in a waiting state and the control is returned to the step S3.

In step S5, the pattern reading unit 120 reads the second deviation detecting patterns 25MC_YS_SP formed on the transporting belt 5 by the image formation unit 110, by using the sensors 17, 18 and 19. In step S6, the execution cycle counter-A is cleared to zero.

In step S7, the detection unit 130 detects whether the deviation of the image of magenta or cyan takes place, based on the position information which is stored by the reading of the second deviation detecting patterns 25MC_YS_SP by the pattern reading unit 120. Specifically, the detection unit 130 in this step S7 detects whether a line width of the straight line patterns or the slanting line patterns in the second deviation detecting patterns 25MC_YS_SP in the sub-scanning direction exceeds a predetermined reference value (for example, 0.7 mm).

When it is detected in the step S7 that the line width exceeds the reference value (0.7 mm), the control is transferred to step S9.

On the other hand, when it is detected in the step S7 that the line width does not exceed the reference value, it is detected in step S8 whether the execution cycle counter-B reaches 30 minutes. When the execution cycle counter-B does not reach 30 minutes in the step S8, the deviation amount detecting device 100 is set in a waiting state and the control is returned to the step S3.

When it is detected in the step S7 that the line width exceeds the reference value (0.7 mm), or when it is detected in the step SS that the execution cycle counter-B reaches 30 minutes, the image formation unit 110 forms the first deviation detecting patterns 26 on the transporting belt 5 in step S9.

Subsequently, in step S10, the pattern reading unit 120 reads the first deviation detecting patterns 26 formed on the transporting belt 5 by the image formation unit 110, by using the sensors 17, 18 and 19.

In step S11, the execution cycle counter-B is cleared to zero. In step S12, the detection unit 130 computes a deviation amount 43D of the main scanning direction and a deviation amount 44D of the sub-scanning direction based on the position information which is stored as a result of the reading of the first deviation detecting patterns 26 by the pattern reading unit 120.

In step S13, the storing unit 140 stores the values of the deviation amounts 43D and 44D in the storage device, such as the RAM 58.

In step S14, it is detected whether the process of the deviation amount detecting device 100 is completed. When the result of the detection in step S14 is affirmative, the process of computation of the amount of deviation by the deviation amount detecting device 100 is terminated at step S15.

When the result of the detection in step S14 is negative, the control is returned to the step S2 in which both the execution cycle counter-A and the execution cycle counter-B are cleared to zero.

The number of the second deviation detecting patterns 25 which have to be formed on the transporting belt 5 is much smaller than that of the first deviation detecting patterns 26. Using the second deviation detecting patterns 25, the deviation amount detecting device 100 of this embodiment is able to detect the occurrence of the deviation efficiently in a short time.

Figure 13:
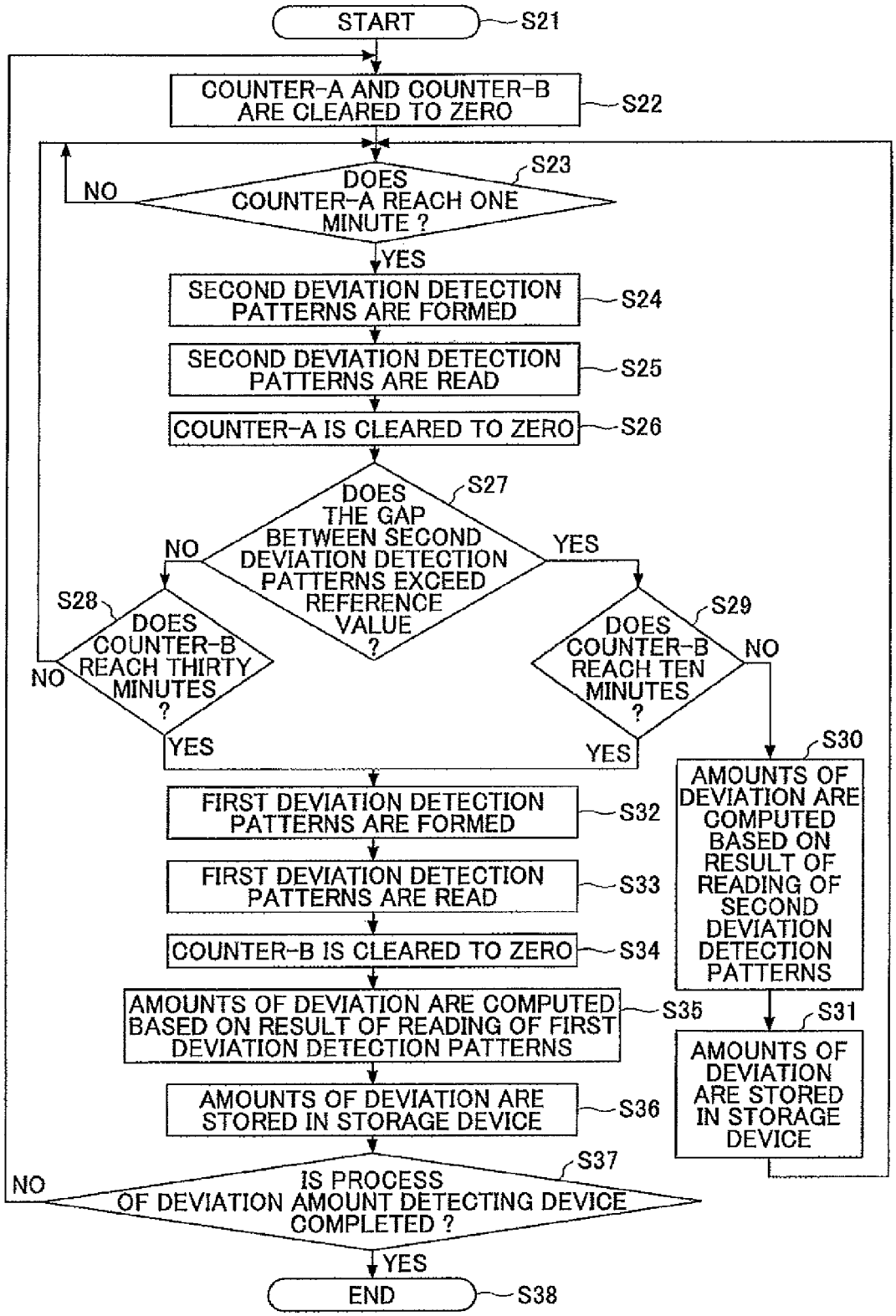
FIG. 13 is a flowchart for explaining the process of computation of the amount of deviation by a deviation amount detecting device of an embodiment of the invention.

Next, the process of computation of the amount of deviation by a deviation amount detecting device of another embodiment of the invention will be described. FIG. 13 is a flowchart for explaining the process of computation of the amount of deviation by the deviation amount detecting device of this embodiment.

In the process of computation of the amount of deviation by the deviation amount detecting device 100 of this embodiment, it is detected whether a deviation for each image of magenta and cyan takes place, by using the second deviation detecting patterns 25MC_YS_AD shown in FIG. 10A. When it is detected that a gap between the image of magenta and the image of cyan takes place, the deviation amount detecting device 100 of this embodiment computes the amount of deviation of the main scanning direction or the sub-scanning direction of one of the color images of magenta and cyan from the position of the other of the color images of magenta and cyan, by using the result of the reading of the second deviation detecting patterns 25MC_YS_AD. Moreover, after a predetermined time has elapsed, the deviation amount detecting device 100 computes the amounts of deviation of the main scanning direction and the sub-scanning direction of each color image of magenta, cyan and yellow from the position of the image of black as the reference color image, by using the first deviation detecting patterns 26.

In the flowchart of FIG. 13, the process of the deviation amount detecting device 100 of this embodiment is started at step S21.

In step S22, the execution cycle counter-A of the process of detection of the deviation using the second deviation detecting patterns 25 and the execution cycle counter-B of the process of computation of the amount of deviation using the first deviation detecting patterns 26 are cleared to zero.

In step S23, it is detected whether the execution cycle counter-A reaches 1 minute. When execution cycle counter-A reaches 1 minute in step S23, the image formation unit 110 forms the second deviation detecting patterns 25MC_YS_AD shown in FIG. 10A on the transporting belt 5 in step S24.

When the execution cycle counter-A does not reach 1 minute in step S23, the deviation amount detecting device 100 is set in a waiting state and the control is returned to the step 323.

In step S25, the pattern reading unit 120 reads the second deviation detecting patterns 25MC YS_AD formed on the transporting belt 5 by the image formation unit 110, by using the sensors 17, 18 and 19. In step S26, the execution cycle counter-A is cleared to zero.

In step S27, the detection unit 130 detects whether the deviation of the image of magenta or cyan takes place, based on the position information which is stored by the reading of the second deviation detecting patterns 25MC_YS_AD by the pattern reading unit 120. Specifically, the detection unit 130 in this step S27 detects whether a gap in the sub-scanning direction between the straight line patterns of the second deviation detecting patterns 25MC_YS_AD or a gap in the sub-scanning direction between the slanting line patterns thereof exceeds a predetermined reference value (for example, 0.1 mm).

When it is detected in the step S27 that the gap exceeds the reference value (0.1 mm), the control is transferred to step S29. In step S29, it is detected whether the execution cycle counter-B reaches 10 minutes.

On the other hand, when it is detected in the step S27 that the gap does not exceed the reference value (0.1 mm), the control is transferred to step S28. In step S28, it is detected whether the execution cycle counters-B reaches 30 minutes. When the execution cycle counter-B does not reach 30 minutes in the step S28, the deviation amount detecting device 100 is set in a waiting state and the control is returned to the step S23.

When the execution cycle counter-B reaches 10 minutes in the step S29, or when the execution cycle counter-B reaches 30 minutes in the step S28, the control is transferred to step S32.

When the execution cycle counter-B does not reach 10 minutes in the step S29, in step S30, the detection unit 130 computes the amount of deviation of the main scanning direction or the sub-scanning direction of one of the color images of magenta and cyan from the position of the other of the color images of magenta and cyan, by using the value of the gap in the sub-scanning direction between the straight line patterns of the second deviation detecting patterns 25MC_YS_AD or the value of the gap in the sub-scanning direction between the slanting line patterns thereof.

It is assumed that, in this embodiment, the amount of deviation of the sub-scanning direction is equal to the value of the gap in the sub-scanning direction between the straight line patterns, and that the amount of deviation of the main scanning direction is computed using the value of the gap in the sub-scanning direction between the slanting line patterns. Specifically, in this embodiment, the inclination angle of the slanting line patterns to the main scanning direction is equal to $\pi/4$, and the amount of deviation of the main scanning direction is equal to the value of the gap in the sub-scanning direction between the slanting line patterns.

In step S31, the storing unit 140 stores the amounts of deviation of the sub-scanning direction and the main scanning direction which are computed using the second deviation detecting patterns 25MC_YS_AD, in the storage device, such as the RAM 58.

After the step S31 is performed, the deviation amount detecting device 100 is set in a waiting state and the control is returned to the step 323.

In step S32, the image formation unit 110 forms the first deviation detecting patterns 26 on the transporting belt.

Subsequently, in step S33, the pattern reading unit 120 reads the first deviation detecting patterns 26 formed on the transporting belt by the image formation unit 110, by using the sensors 17, 18 and 19.

In step S34, the execution cycle counter-B is cleared to zero. In step S35, the detection unit 130 computes a deviation amount 43D of the main scanning direction and a deviation amount 44D of the sub-scanning direction based on the position information which is stored as a result of the reading of the first deviation detecting patterns 26 by the pattern reading unit 120.

In step S36, the storing unit 140 stores the values of the deviation amounts 43D and 44D in the storage device, such as the RAM 58.

In step S37, it is detected whether the process of the deviation amount detecting device 100 is completed. When the result of the detection in step S37 is affirmative, the process of computation of the amount of deviation by the deviation amount detecting device 100 is terminated at step S38.

When the result of the detection in step S37 is negative, the control is returned to the step S22 in which both the execution cycle counter-A and the execution cycle counter-B are cleared to zero.

The number of the second deviation detecting patterns 25 which have to be formed on the transporting belt 5 is much smaller than that of the first deviation detecting patterns 26. Using the second deviation detecting patterns 25, the deviation amount detecting device 100 of this embodiment is able to detect the occurrence of the deviation efficiently in a short time.

The present invention is not limited to the specifically disclosed embodiments, and variations and modifications may be made without departing from the scope of the present invention.

The present application is based on Japanese patent application No. 2008-016581, filed on Jan. 28, 2008, and Japanese patent application No. 2009-011933, filed on Jan. 22, 2009, the contents of which are incorporated herein by reference in their entirety.

What is claimed is:

1. A deviation amount detecting device which computes an amount of deviation for each of multiple toner images of different colors in an electrophotographic color image forming device wherein a color image is formed on a transporting member by superimposing the toner images of different colors, the deviation amount detecting device comprising:

an image formation unit configured to form on the transporting member a set of second deviation detecting patterns which are of different colors and of identical shape and superimposed at a same position in order to detect a deviation for each of toner images of the different colors;

a pattern reading unit configured to read the set of second deviation detecting patterns formed on the transporting member by the image formation unit; and a detection unit configured to detect whether a deviation for each of the toner images of the different colors on the transporting member takes place, based on position information which is stored as a result of the reading of the set of second deviation detecting patterns by the pattern reading unit, wherein the image formation unit is further configured to form, on the transporting member, a set of first deviation detecting patterns which are of different colors and have different shapes, and an area of the transporting member on which the set of second deviation detecting patterns are formed is smaller than an area of the transporting member on which the set of first deviation detecting patterns are formed, wherein the set of first deviation detecting patterns are formed on the transporting member by the image formation unit when the detection unit detects that the deviation takes place, wherein the set of second deviation detecting patterns are formed on the transporting member by laser beams which pass through lenses located at opposite positions around a center of a polygon mirror in an exposure unit of the image forming device and disposed in a vicinity of a drive motor which drives the polygon mirror, and wherein the lenses are two deflector lenses which are disposed in a vicinity of the polygon mirror in the exposure unit.

2. A deviation amount detecting method for use in a deviation amount detecting device which computes an amount of deviation for each of multiple toner images of different colors in an electrophotographic color image forming device wherein a color image is formed on a transporting member by superimposing the toner images of different colors, the deviation amount detecting method comprising:

forming on the transporting member a set of second deviation detecting patterns which are of different colors and of identical shape and superimposed at a same position in order to detect a deviation for each of toner images of the different colors;

reading the set of second deviation detecting patterns formed on the transporting member; and detecting whether a deviation for each of the toner images of the different colors on the transporting member takes place, based on position information which is stored as a result of the reading of the set of second deviation detecting patterns, wherein a set of first deviation detecting patterns which are of different colors and have different shapes are formed on the transporting member, and an area of the transporting member on which the set of second deviation detecting patterns are formed is smaller than an area of the transporting member on which the set of first deviation detecting patterns are formed, wherein the set of first deviation detecting patterns are formed on the transporting member when it is detected that the deviation takes place, wherein the set of second deviation detecting patterns are formed on the transporting member by laser beams which pass through lenses located at opposite positions around a center of a polygon mirror in an exposure unit of the image forming device and disposed in a vicinity of a drive motor which drives the polygon mirror, and wherein the lenses are two deflector lenses which are disposed in a vicinity of the polygon minor in the exposure unit.

3. A computer-readable recording medium storing a deviation amount detecting program which, when executed by a computer, causes the computer to perform the deviation amount detecting method according to claim 2.

4. A deviation amount detecting method for use in a deviation amount detecting device which computes an amount of deviation for each of multiple toner images of different colors in an electrophotographic color image forming device wherein a color image is formed on a transporting member by superimposing the toner images of different colors, the deviation amount detecting method comprising:

forming on the transporting member a set of second deviation detecting patterns which are of different colors and of identical shape and superimposed at a same position in order to detect a deviation for each of toner images of the different colors;

reading the set of second deviation detecting patterns formed on the transporting member;

detecting whether a deviation for each of the toner images of the different colors on the transporting member takes place, based on position information which is stored as a result of the reading of the set of second deviation detecting patterns;

forming, when it is detected that the deviation takes place, a set of first deviation detecting patterns on the transporting member, the set of first deviation detecting patterns being of different colors and having different shapes;

reading the set of first deviation detecting patterns formed on the transporting member;

computing an amount of deviation based on position information which is stored as a result of the reading of the set of first deviation detecting patterns; and storing the amount of deviation in a storage device, wherein an area of the transporting member on which the set of second deviation detecting patterns are formed is smaller than an area of the transporting member on which the set of first deviation detecting patterns are formed, wherein the set of second deviation detecting patterns are formed on the transporting member by laser beams which pass through lenses located at opposite positions around a center of a polygon mirror in an exposure unit of the image forming device and disposed in a vicinity of a drive motor which drives the polygon mirror, and wherein the lenses are two deflector lenses which are disposed in a vicinity of the polygon mirror in the exposure unit.

* * * * *